United States Patent [19]

Chano et al.

[11] 3,970,014

[45] July 20, 1976

[54] AUTOMATIC SEWING MACHINE

[75] Inventors: Takashi Chano, Yokohama; Koji Masuda, Sagamihara, both of Japan

[73] Assignee: Kayabakoyo-Kabushiki-Kaisha, Tokyo, Japan

[22] Filed: Nov. 6, 1974

[21] Appl. No.: 521,210

[52] U.S. Cl. ..... 112/121.11; 112/203

[51] Int. Cl.[2] ..... D05B 19/00

[58] Field of Search ..... 112/121.11, 121.15, 112/121.12, 203, 153, 152, 136; 250/548, 202; 226/17, 15

[56] References Cited

UNITED STATES PATENTS

| | | | |
|---|---|---|---|
| 2,947,057 | 8/1960 | Meagher, Jr. | 226/17 X |
| 3,013,513 | 12/1961 | Judelson | 112/203 |
| 3,417,718 | 12/1968 | Andersson | 112/203 |
| 3,461,302 | 8/1969 | Benson et al. | 250/548 |
| 3,827,381 | 8/1974 | Baanstra et al. | 112/121.11 |
| 3,867,889 | 2/1975 | Conner, Jr. | 112/121.11 |

*Primary Examiner*—Werner H. Schroeder
*Assistant Examiner*—Peter Nerbun
*Attorney, Agent, or Firm*—Saul Jecies

[57] ABSTRACT

An automatic sewing machine is disclosed which includes a position control device or a device to align automatically the edges of sheet materials to be joined as they are fed toward the needle. The device comprises a sensor unit for detecting the side edges of the upper and lower sheet materials to be joined, a manipulator unit comprising a pair of upper and lower manipulator arms which displace traversely the upper and lower sheet materials independently of each so as to align the side edges thereof, and a control unit which controls the timing of the operation of the manipulator unit to the operations of various mechanisms of the sewing machine such as an automatic feed reverse mechanism, an automatic thread cutting mechanism and so on. The seam formed is spaced apart from the aligned edges exactly by a predetermined distance or margin which may be selectively varied.

5 Claims, 8 Drawing Figures

AUTOMATIC SEWING MACHINE

BACKGROUND OF THE INVENTION

The present invention relates to generally an automatic sewing machine of the type mainly for sewing the sheet materials with their side edges aligned, and more particularly a device for automatically aligning the side edges of the soft sheet materials such as fabric during the sewing or stitching.

With automatic sewing machines, it is, in general, difficult to automatically feed the sheet materials to be joined through the machine wth a predetermined margin to sew up while correctly aligning their side edges. This will become more difficult especially when the soft upper and lower sheet materials of various patterns are stitched together wth their edges aligned by the high-speed industrial sewing machine. Therefore, the operator must manually align the side edges of the sheet materials to be joined as they are fed toward the needle. The result is the inevitable intermittent sewing operation. Thus even the conventional automatic industrial sewing machines require much time and labor. There have been of course devised and demonstrated various types of automatic industrial sewing machines especially designed for accomplishing special works such as attaching collars, cuffs, and so on which, in general, have special patterns. Therefore these machines are not adapted for universal uses or purposes.

SUMMARY OF THE INVENTION

One of the objects of the present invention is, therefore, to provide an automatic sewing machine for automatically aligning the edges of the upper and lower sheets of fabric of different materials presenting different edge formations and automatically sewing them with a predetermined margin to sew up; that is, with the seam line being correctly spaced apart from the edge by a predetermined distance.

Even though the present invention is, in general, adapted for sewing two sheet materials with their edges aligned, according to one embodiment thereof which is especially adapted for sewing two sheets of fabric with their side edges aligned, includes a portion control device comprising sensor means for not only detecting the side edges of the upper and lower sheets to be joined but also the end point of the sewing; that is, a point at which the sewing or stitching must be stopped; and manipulator means for displacing, in response to the signal from the sensor means, the upper and lower sheets independently of each other and transversely of the direction of the feed so as to align their side edges.

According to another preferred embodiment of the present invention, the position control device comprises sensor means and manipulator means is correctly determined with respect to a reference point; that is, the center of a needle hole in a throat plate of a sewing machine. Sensor means detects the side edges of the upper and lower sheet materials and generates the electrical signal representing whether the detected side edges are precisely spaced apart or not from the center of the needle hole by a predetermined distance. In response to this electrical signal, manipulator means displace the upper and lower sheet materials independently of each other so that their side edges may be placed in correct position; that is, they may be aligned with each other. The combination of sensor means and manipulator means is one of the most important features of the present invention.

In order to control the timing of the operation of the position control device to the operations by various mechanisms of the sewing machine, a control unit is provided. When the operator sets two sheet materials to be joined to a predetermined position on the worktable of the sewing machine and then pushes the start button, the control unit gives the control signal to the sewing machine so that the lowspeed reverse sewing may be started. When a predetermined number of stitches made by the low-speed reverse sewing are counted by the control unit, the latter gives the control signal to the sewing machine so that the high-speed forward sewing may be started. The control unit also gives the control signal to the position control device so that the side edges of the sheet materials to be joined may be precisely positioned with respect to the center of the needle hole of the throat plate of the sewing machine. The position control device is advantageous not only in that the operator is completely freed during the high-speed forward sewing but also in that the continuous sewing operation may be feasible.

The high-speed forward sewing is interrupted immediately when sensor means detects the end points of the sewing. That is, in response to the electrical signal from sensor means, the control unit gives the control signal to the sewing machine so that the low-speed forward sewing may be started. When a predetermined number of stitches formed by the low-speed forward sewing are counted by the control unit, the latter gives the control signal to the sewing machine so that the low-speed reverse sewing may be started. When a predetermined number of stitches formed by the low-speed reverse sewing are counted by the control unit, the latter gives the control signal to the sewing machine so that the latter is reset for the next sewing operation. Thereafter, the operator cuts the thread. When the sewing machine is equipped with an automatic thread cutter, the control unit gives the control signal to the automatic thread cutter when the low-speed reverse sewing is accomplished so that the thread may be automatically cut off and the sewing machine may be automatically reset for the next operation.

According to the present invention, except the setting of the sheet materials to be joined and the depression of the start button by the operator, the whole sewing operation may be automatically accomplished with the side edges of the sheet materials correctly aligned with each other. Therefore the provision of the control unit for controlling the timing of the operation of the position control device to the operations of the various mechanisms of the automatic sewing machine is also another important fearture of the present invention. Moreover, the present invention provides means for manually stopping the automatic sewing operation at any moment when an accident occurs or improper stitchings are formed.

The above and other objects, features and advantages of the present invention will become more apparent from the following description of one preferred embodiment thereof taken in conjunction with the accompanying drawing.

DESCRIPTION OF THE PREFERRED EMBODIMENT

Figure 1:
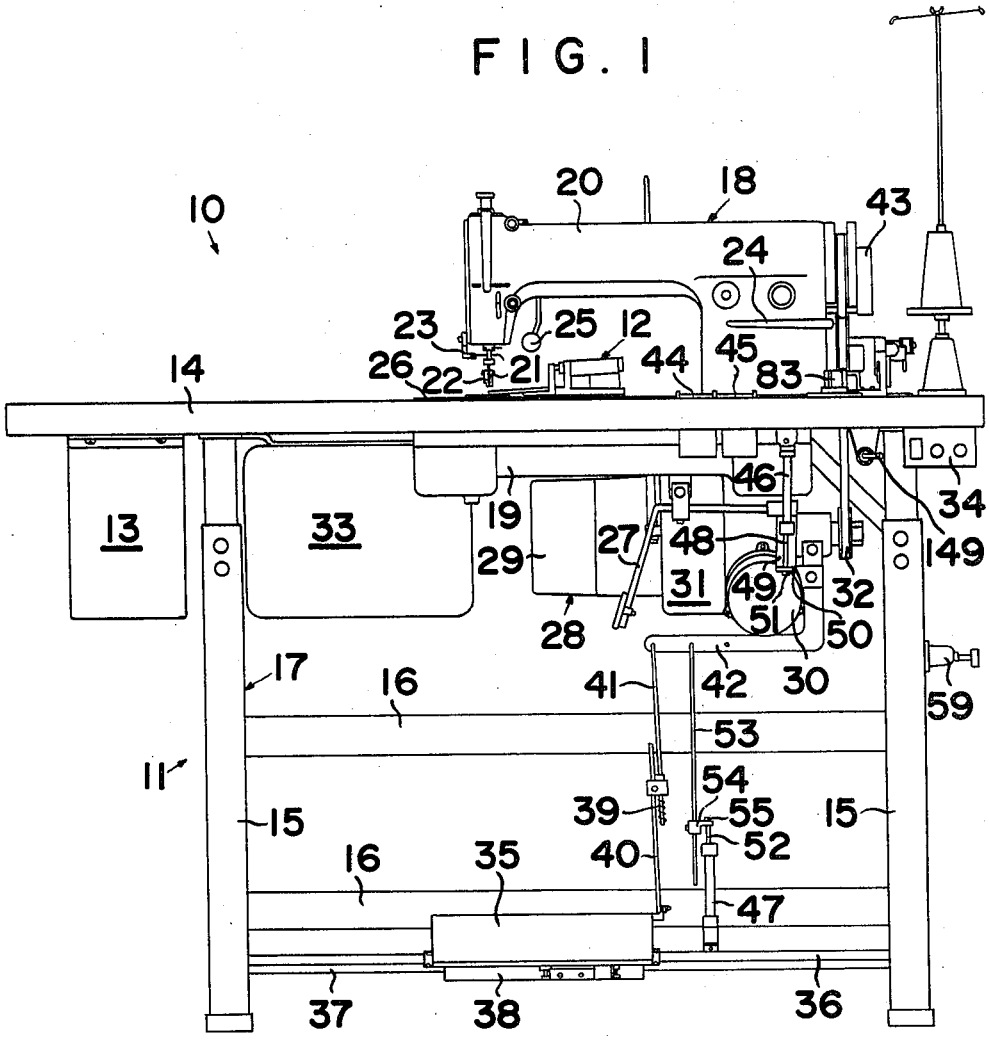
FIG. 1 is a front view of an automatic sewing machine in accordance with the present invention.
Figure 2:
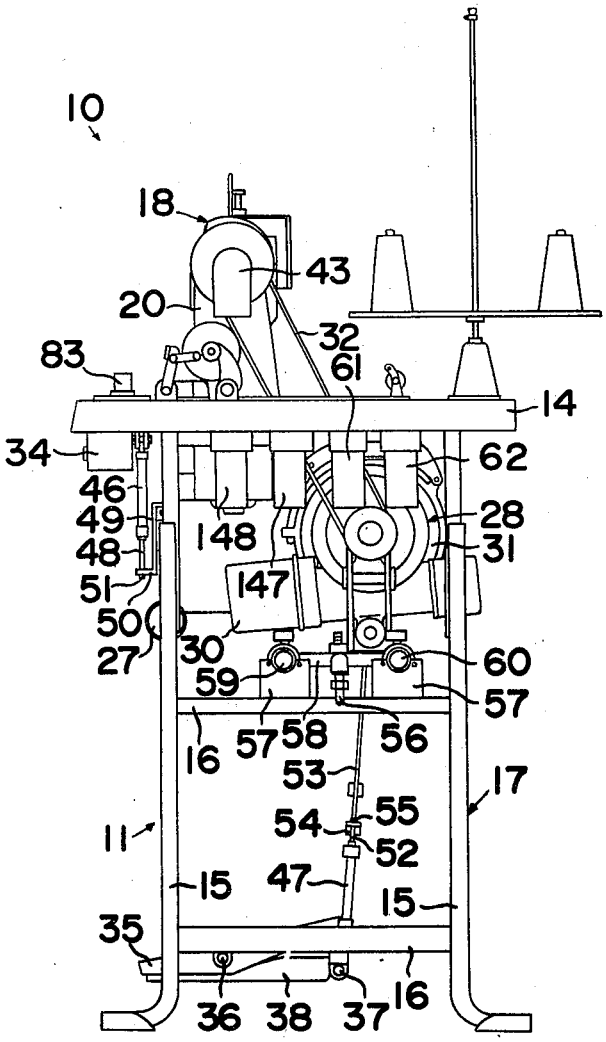
FIG. 2 is a side view thereof.

Referring to FIGS. 1 and 2, an automatic sewing machine in accordance with the present invention and generally indicated by the reference numeral 10, comprises, in general, a main body 11 or sewing machine assembly of the type similar in construction and mode of operation to the conventional automatic sewing machines; a position control device or sheet material alignment control device in accordance with the present invention and generally indicated by 12; and a control box 13 for controlling various operations of the automatic sewing machine. The sheet material alignment control device 12 is disposed upon a worktable 14 as will be described in detail hereinafter, and the control unit 13 is attached to the undersurface of the worktable 14.

As with the conventional automatic sewing machines, the main body 11 comprises an arm bed assembly 18 mounted on the worktable 14 which in turn is supported by a supporting frame structure 17 consisting of four legs 15 and a plurality of brace members 16. The rear side of the arm bed assembly 18 that is its bed 26 is hinged to the rear side edge of an oil pan 19 which in turn is made fast to the undersurface of the worktable 14 so that the arm-bed assembly 18 may be inclined backwardly; that is in the direct opposite to the operator. The overhanging arm 20 of the arm-bed assembly 18 includes a needle 21, a pressure foot 22, a thread cutter 23, and reverse levers 24 and 25 while the bed 26 which covers the oil pan 19, includes a feed mechanism and a rotating hook assembly (both of which are not shown) and a presser foot lifting lever 27. The stitching or sewing operation is carried out in a manner well known in the art.

An electric motor driving mechanism 28, which drives the sewing machine, comprises a main motor 29, an auxiliary motor 30, and a clutch 31, all of which are disposed below the worktable 14. The power is transmitted from the driving mechanism 28 to the arm-bed assembly 18 through an endless belt 32. A main switch 34 and a control box 33 for controlling various mechanisms in the arm-bed assembly 18 are attached to the undersurface of the worktable 14, and a foot pedal 35, which gives the signal to the control box 33 when depressed, is carried by a shaft 36 which in turn is rotatably supported by one pair of opposed brace members 6. When the foot pedal 35 is depressed, a switch 38 interposed between the shaft 36 and a supporting shaft 37 disposed in parallel therewith is actuated in a manner to be described hereinafter. The foot pedal 35 is also operatively coupled to the clutch 31 in the driving mechanism 28 through connecting levers 40 and 41, which are coupled through a coiled spring 39, and a crank lever 43. Thus, when the foot pedal 35 is depressed to the maximum, the clutch 31 is engaged or disengaged.

When the main switch 34 is thrown, the main motor 29, which rotates at a high speed, is driven, but the clutch 31 is coupled to the auxiliary motor 30, which rotates at a low speed, so that no power is transmitted to the mechanisms in the arm-bed assembly 18. When the lever 27 is pushd toward the right, the presser foot 22 is lifted so that two sheet materials or fabrics to be joined may be placed in the sewing position in a manner well known in the art. Thereafter, the lever 27 is released, the foot presser 22 is lowered to hold the sheet materials in position. Thereafter, the foot pedal 35 is depressed one step further forward so that a low speed-stitching switch in the switch assembly 38 is closed. The low-speed sewing relay in the control box 33 is energized so that the auxiliary motor 30 is driven. Thus the low-speed switching may be started.

In general, when the sewing is started, the reverse lever 24 or 25 is kept depressed so that a clutch for the feed mechanism which is operatively coupled to the lever 24 and 25 through a mechanical linkage or solenoid, is switched so that the feed mechanism reverses the feed of the sheet materials. The reverse lever 24 or 25 is released after a predetermined number of stitches have been made in the reverse direction; that is, toward the operator. Then the clutch in the feed mechanism switches the reverse feed to the forward feed. Thus, the low-speed forward sewing is started. When the foot pedal 35 is depressed further, the clutch 31 couples the main motor 29 to the mechanisms in the arm-bed assembly 18, disengaging the auxiliary motor 30 so that the high-speed forward sewing may be started. When the needle reaches a predetermined position, the foot pedal 35 is released back to the first step position and the reverse lever 24 or 25 is depressed, then the low-speed reverse switching is started. After a predetermined number of stitches are made in the reverse direction, the foot pedal 35 is further depressed again so that the low-speed switch in the switch assembly 38 is opened while a thread cutting switch is closed to energize a relay in the control box 33. The control box 33 cooperates with a slip ring 43 on the arm 20 of the arm-bed assembly 18 to control the rotation of the auxiliary motor 30 so that when the needle 21 reaches the lowermost position, the control box 33 gives the control signal to the thread cutter 23. Thus the thread is cut off when the needle 21 is being lifted. Thereafter, the auxiliary motor 30 is stopped when the needle 21 is lifted to the uppermost position. Thereafter, the foot pressor lifting lever 27 is depressed to lift the foot pressor 22 so that the stitched or sewn sheet materials may be taken out of the worktable 14.

With the main body 11 of the conventional type described, the operator is required not only to operate the foot pressor lifting lever 27, the reverse feed lever 24 or 25, and the foot pedal 36 but also to hold the sheet materials to be joined in such a way that their edges are aligned with each other during stitching. The present invention, therefore, provides the sheet material alignment control device 12 and its control unit 13 in order to relieve the burden imposed upon the operator.

Next, referring still FIGS. 1 and 2, the position or edge alignment control device 12 and its control unit 13 in accordance with the present invention will be described in detail hereinafter. A start button 44 and a stop button 45 are embedded into the worktable 14. When the start button 44 is depressed, the control unit 13 is actuated so as to control all of the operations of the various mechanisms of the main body 11. When the operator detects any defective or improper stitches during operation, he pushes the stop button 45 so that the sequential operation is interrupted and the automatic sewing mahcine is reset. Thus, the stop button 45 is used as an emergency button.

In order to automatically control the vertical movement of the pressor foot 22 and the operation of the clutch 31 in the driving mechanism 28 in response to the control signal from the control unit 13, two air cylinders 46 and 47 are operatively coupled to the presser foot lifting lever 27 and to the crank lever 42 of the clutch 31, respectively. The base of the air cylinder 46 is hinged to the undersurface of the worktable 14 while its piston rod 48 has its free end extended through a hole formed in a horizontal arm 50 of a lever 49 depending from the base of the pressor foot lifting lever 27, and attached to the undersurface of the horizontal arm 50 with a stop or retaining member 51. The base of the air cylinder 47 is hinged to the shaft 37 while its piston rod 52 has its free end fitted into a retaining member 54 which is attached to a connecting lever 53 depending from the crank lever 42 in such a way that the retaining member 54 may be displaced along the connecting rod 53. A stop or retaining member 55 is attached to the extreme end of the piston rod 52, and is made into engagement with the top of the retaining member 54 so that the piston rod 52 is prevented from being disconnected from the retaining member 54.

When the air cylinder 46 is so actuated as to retract its piston rod 48, the pressor foot lifting lever 27 is caused to swing in the counterclockwise direction so that the pressor foot 22 may be lifted. When the air cylinder 47 is so actuated as to retract its cylinder rod 52, the crank lever 42 is pulled down so that the clutch 31 is so actuated as to couple the main motor 29 to the mechanisms in the arm-bed assembly 18. Even though the air cylinders 46 and 47 are provided, the operator may manually control the pressor foot lifting lever and the foot pedal 35. That is when the operator depresses the presser foot lifting lever 27 and the foot pedal 35, the connecting lever 49 and the retaining member 54 are spaced apart from their stops 51 and 55 so that the pressor foot 22 may be lifted and the various operations described above and associated with the depression of the foot pedal 25 may be accomplished.

The air under pressure required for actuating the air cylinders 46 and 47 are supplied from a suitable air source such as an air compressor (not shown) through an air supply line (not shown) which is coupled to a quick-coupling or quick-connect joint 56. As best shown in FIG. 2, the air under pressure flows from the joint 56 into an air line 58 held upon a supporting member 57 which in turn is mounted upon a transverse beam 16, and is delivered to a pressor foot operating solenoid valve 61 and a clutch operating solenoid valve 62 attached to the undersurface of the worktable 14. In response to the control signals from the control unit 13, the solenoid operated valves 61 and 62 are actuated to control the air flow to or out from the air cylinders 46 and 47. Thus the air cylinders 46 and 47 are extended or retracted in response to the control signals from the control unit 13.

Figure 3:
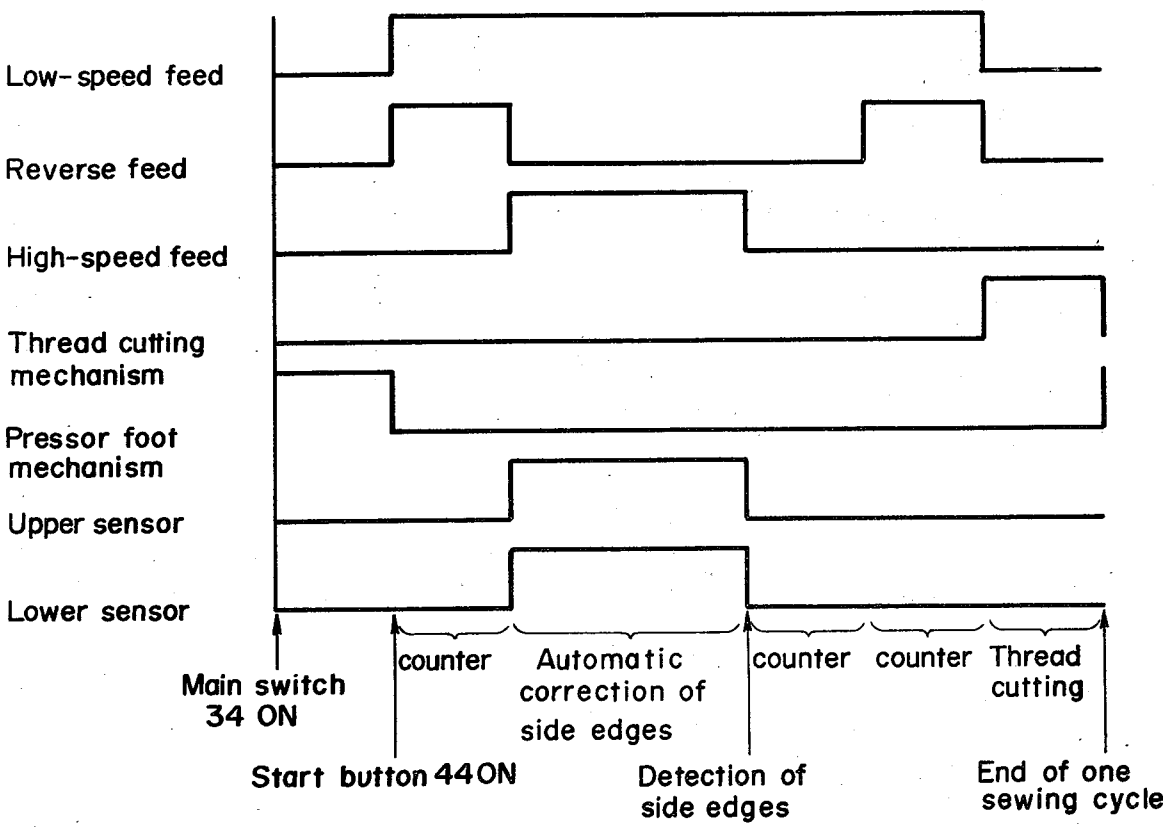
FIG. 3 is a sequence chart representing the sequence of the control operations thereof.

The control unit 13 controls various operations of the sewing machine according to the sequences shown in FIG. 3. That is, when the main switch 34 is thrown, the control unit 13 gives the control signal to the solenoid valve 61 for the pressor foot so that the piston rod of the air cylinder 46 is retracted. Consequently the pressor foot 22 is lifted to permit the insertion of the sheet materials to be joined between the pressor foot 22 and the worktable 14. Thereafter, the operator pushes the start button 44. Then the control unit 13 stops sending the signal to the solenoid operated valve 61 so that the piston rod of the air cylinder 46 is extended. Thus the pressor foot 22 is lowered to hold the sheet materials to be joined in place. Meanwhile, in response to the control signals from the control unit 13, the low-speed-sewing switch in the control box 33 and the solenoid circuit for the clutch in the feed mechanism in the arm-bed assembly 18 are closed so that the auxiliary motor 30 is driven and the clutch in the feed mechanism is switched to the reverse feed. Therefore the sheet materials to be joined are fed toward the operator by the cooperation of the pressor foot 22 and the feed mechanism, and are stitched at a low speed. The number of stitches made in the low-speed reverse sewing is counted by a counter (not shown) in the control unit 13. When a predetermined number of stitches are counted, the solenoid circuit for the feed mechanism is opened so that the forward feed is started. Simultaneously, in response to the control signal from the control unit 13, the solenoid valve 62 is so actuated as to cause the air cylinder 47 to retract its piston rod 52. The crank lever 52 is pulled downward so that the clutch 31 couples the main motor 29 to the mechanisms in the arm-bed assembly 18. Thus the high-speed forward stitching or sewing is started. At the moment when the low-speed reverse sewing is switched to the high-speed forward sewing as the counter counts a predetermined number of stitches made in the low-speed reverse stitching, the control unit 13 gives the control signal to the position or alignment control device 12 so that the sheet materials are stitched together at a high speed while their edges are automatically aligned with each other during the high-speed forward sewing operation.

Figure 4:
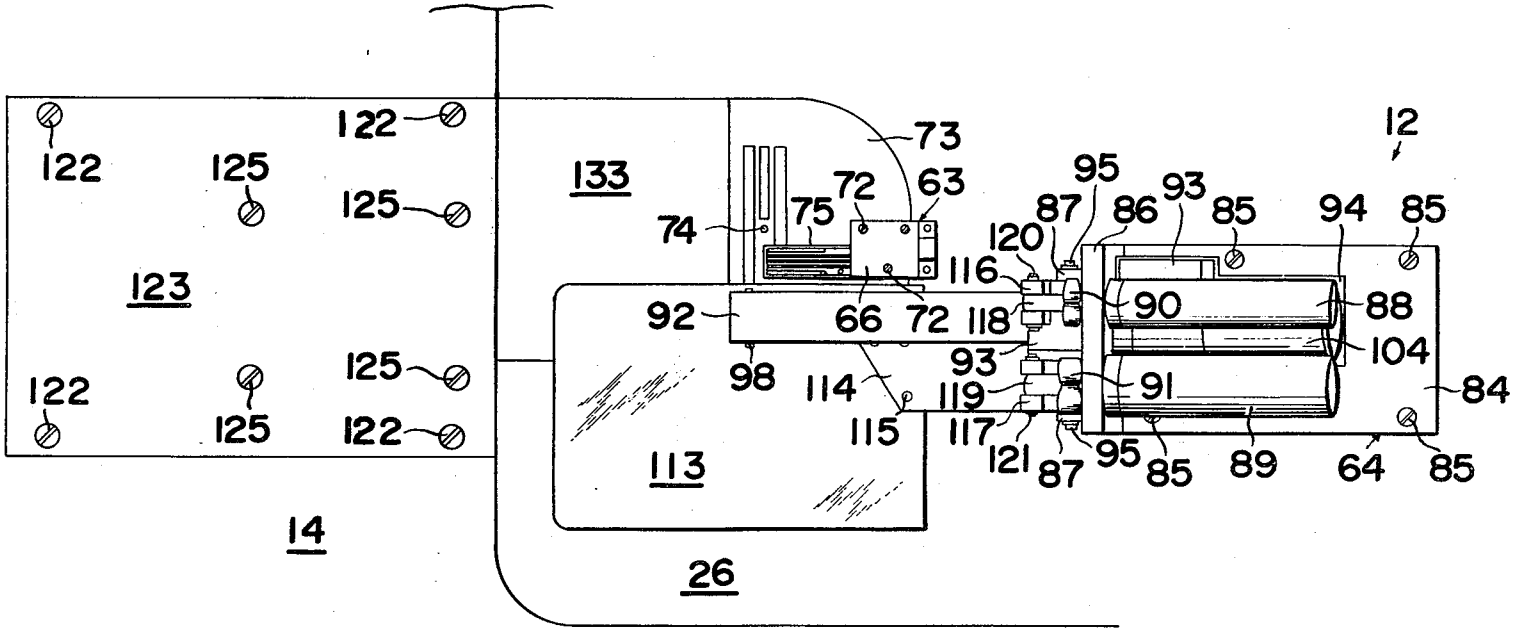
FIG. 4 is a top view of a position control device.

Next, referring to FIGS. 4 and 5 the sheet material alignment control device 12 will be described in detail hereinafter. In general, the control device 12 comprises a pair of upper and lower manipulators 64 and 65 which precisely aligns the side edges of the sheet materials to be joined in response to the control signal from a sensor unit generally indicated by 63.

Figure 6:
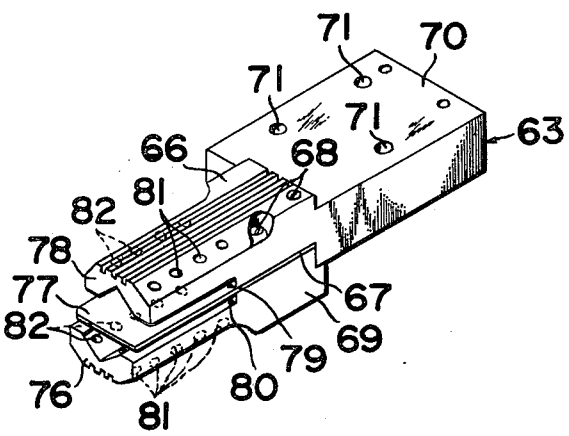
FIG. 6 is a perspective view of a sensor unit.

Referring to FIG. 6 the sensor unit 63 will be first described in detail. The sensor unit 63 comprises, in general, a pair of upper and lower holders 66 and 69 with a reflecting plate 67 interposed therebetween and held securely in position with screws 68. The upper holder 66 is securely attached to a throat plate 73, as best shown in FIG. 4, with screws 72 fitted into holes 71 formed in the base 70 of the upper holder 66, in such a way that the left side edge of the sensor unit 63 is precisely held in position with reference to and spaced apart from the center of a needle hole 74 in the throat plate 73. The lower holder 69 is fitted into and held in an opening 75 formed in the throat plate 73.

Referring back to FIG. 6, both the free ends (left ends in FIG. 6) of the lower holder 69 and reflecting plate 67 are extended beyond the free end 78 of the upper holder 66. The undersurface of the upper holder 66 and the upper surface of the lower holder 69 are stepped as shown at 79 and 80 so that the upper and lower holders 66 and 69 are spaced apart from the reflecting plate 67 by a predetermined distance. A V-shaped groove is formed in each of the stepped surfaces 79 and 80 of the upper and lower holders 66 and 69, and four light emitting diodes 81 and four phototransistors 82 are disposed or embedded in the side walls, respectively, of the V-shaped groove of the upper holder 66 in such a way that the light emitted from each light emitting diode 71 is reflected back by the reflecting plate 67 and is intercepted by the corresponding phototransistor 82. In like manner, five light emitting diodes 81 and five corresponding phototransistors 82 are embedded in the side walls, respectively, of the V-shaped groove of the lower holder 69. The leftmost pair of the light emitting diode 81 and phototransducer 82 on the lower holder 69 is for detecting the starting or finishing point of the stitching while the remaining pairs are for detecting the side edges of the upper and lower sheet materials to be joined. A rotary switch 83 (See FIG. 1) is disposed upon the worktable 14 so that any group each consisting of one pair of light emitting diode 81 and phototransistor 82 on the upper holder 66 and a corresponding pair on the lower holder 69; that is, the lower pair vertically aligned with the upper pair, may be selectively activated. The upper sheet material is inserted through the stepped portion or space 79 between the upper holder 66 and the reflector 67 while the lower sheet material, into the stepped portion or space 80 between the reflector 67 and the lower holder 69. When the sheet material completely covers both the light emitting diode 81 and its corresponding phototransistor 82, the light emitted from the light emitting diode 81 is reflected back from the sheet material and is intercepted by the phototransistor 82 so that the signal current from the latter is small. On the other hand, when the sheet material does not intervene between the light emitting diode 81 and its corresponding phototransistor 82, the light from the light emitting diode 81 is reflected back from the reflector 67 and is intercepted by the phototransistor 82 so that the signal current from the latter is large. Thus the finishing point of the stitching and the edges of the sheet materials to be joined may be detected from the variation in signal current derived from the phototransistors 82.

Next, referring back to FIGS. 4 and 5 the pair of upper and lower manipulator members generaly indicated by 64 and 65, respectively, which coact to attain the precise alignment between the edges of the upper and lower sheet materials to be joined in response to the control signal derived from the sensor unit 63, will be described in detail hereinafter.

The base 84 of the upper manipulator member 64 is attached with screws 85 to the bed 26 below the overhanging arm 20 and forwardly of the sensor unit 63. The base 84 is provided with an upturned bracket 86 slightly inclined with respect to the vertical and a pair of projections 87 extended outwardly of the left side of the base 84. To the upturned bracket 86 are attached air cylinders 88 and 89 with nuts 90 and 91.

Figure 7:
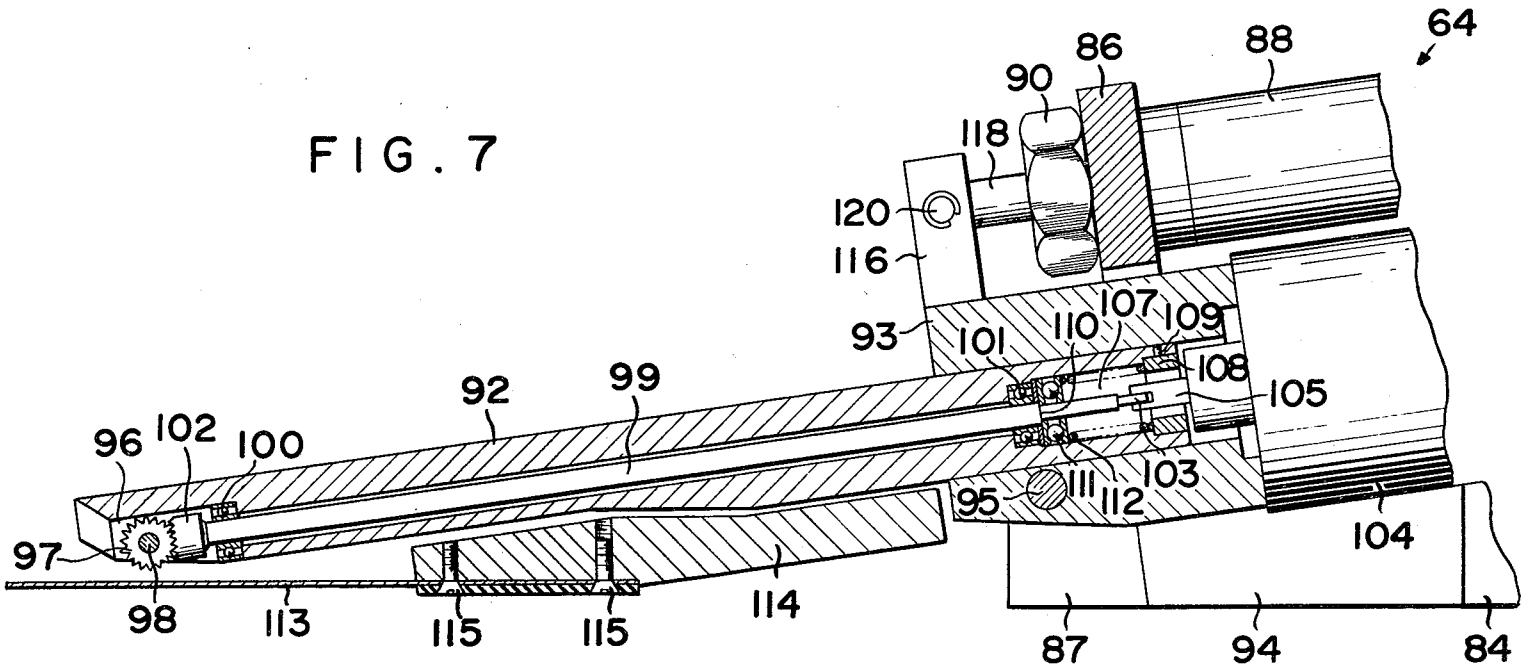
FIG. 7 is a longitudinal sectional view of an upper manipulator member.

Next referring to FIG. 7, an arm assembly 92 of the upper manipulator member 64, which is the most important part thereof, will be described. The base of the arm assembly 92 is fitted into a supporting block 93 which in turn is fitted into the opening between the projections 87 of the base 84 and is swingably supported therebetween with pins 95. The leading end of the arm 92 extending outwardly downwardly from the supporting block 93 at a small angle with respect to the horizonal, extends beyond the vertical line passing through the center of the needle hole 74 in the throat plate 73, and terminates into a recess 96 which opens at the undersurface of the arm 92. A pinion 97 is rotatably carried by a shaft 98 within this recess 96 in such a manner that the lower portion of the pinion 97 sightly extends out of the recess 96. The pinion 97 is in mesh with a crown gear 102 carried at the left end of a driving shaft 99 which extends within the arm 92 coaxially thereof and is supported by roller bearings 100 and 101. The driving shaft 99 has its right end coupled through a tongue-and-groove joint 103 to a shaft 105 of an electric motor 104 which is held in position with knock pins 106 (See FIG. 5) inserted into the holes (not shown) formed through the walls at the base of the supporting block or bracket 93. Thus the rotation of the motor 104 is transmitted through the transmission shaft 99 and the crown gear 102 to the pinion 97. In order to ensure the positive engagement between the pinion 97 and the crown gear 102, the driving shaft 99 is normally biased toward the left under the force of a coiled spring 112 loaded between a thrust bearing 111 and a cap 108 in an axial large-diameter hole 108 formed at the base of the arm 92. The cap 108 is securely held in position with a knock pin 109 in the vicinity of the hole 108 while the thrust bearing 111 is fitted over the reduced diameter portion of the driving shaft 99 and is pressed against the stepped portion 110 thereof.

Referring back to FIGS. 4 and 5, an L-shaped lever with two arms 114 and 117 has its base pivoted with a pin 96 to the base 84, and its one upturned arm 117 pivoted with a pin 121 to the piston rod 119 of the air cylinder 89. A separating plate 113, which is also one of the most important parts of the upper manipulator member 64, is attached with screws 115 to the undersurface of the other arm 114 at the end portion thereof. The separating plate 113 is flat, and extends below the end portion of the arm 92 over the worktable 14.

The upturned connecting arm 116 formed integral with the supporting block 93 for the arm 92 is also pivoted with a pin 120 to the piston rod 88 of the air cylinder 89.

The lower manipulator member generally indicated by 66 is disposed below the worktable 14 in symmetrical relation with the upper manipulator member 64. That is, a mounting plate 123 is disposed within an opening formed through the worktable 14 and is securely held thereto with screws 122 in such a way that the upper surface of the mounting plate 123 flushes with the upper surface of the worktable 14. A base 124 of the lower manipulator member 65 is attached with screws 125 to the undersurface of the mounting plate 123. The base 124 is provided with brackets 126 and 127 which are formed integral with the base 124 and are depending at a slight angle with respect to the vertical an in parallel with each other. A guide block 129 is disposed between the brackets 126 and 127 so as to be movable along a guide rod 128 extending between and supported by the brackets 126 and 127.

An arm 130 of the lower manipulator member 65, which is one of the most important parts thereof, is substantially similar in construction to the arm 92 of the upper manipulator member 64, and its supporting block 131 is pivoted with a pin 132 to the guide block 129. The arm 130 extends from the supporting block 131 outwardly upwardly at a slight angle with respect to the horizontal, and has its end slightly exposed upwardly through an opening 134 formed through the throat plate 73 and a square plate 133. A pinion 135 which is carried by a shaft 136 at the end of the arm 130 is located below the separating plate 113 in opposed relation with the pinion 97 on the arm 92 of the upper manipulator member 64, and is driven by a motor (not shown) mounted at the base of the supporting block 131 as with the case of the motor 104 of the upper manipulator member 64.

Figure 8:
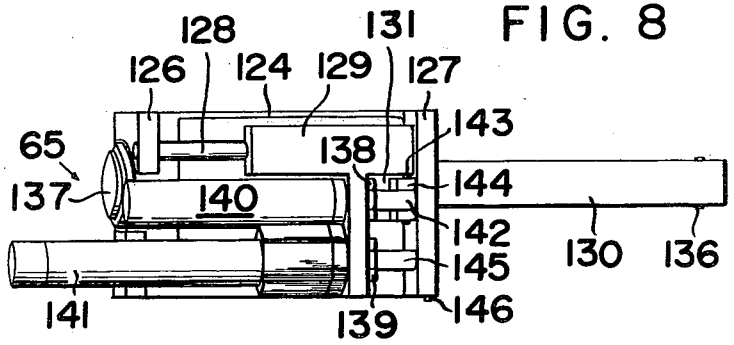
FIG. 8 is a bottom view of a lower manipulator member.

Next referring to FIG. 8, the construction of the lower manipulator member 65 will be further explained in detail. Two air cylinders 140 and 141 are securely held in position with nuts 138 and 139 upon the guide block 129. The piston rod 142 of one air cylinder 140 is pivoted with a pin 143 to an arm member 146 formed integral with the supporting block 131 while the piston rod 145 of the other air cylinder 141, with a pin 146 to the bracket 127 of the base 124.

The air under pressure for actuating the air cylinders 88, 89, and 140 of the upper and lower manipulator members 64 and 65 is delivered through an air line (not shown) from the air line 58 (See FIG. 2) through pressure control valves 59 and 60 to solenoid operated valves 147 and 148 for the upper and lower manipulator members 64 and 65, respectively, and attached to the undersurface of the worktable 14 as best shown in FIG. 2. In response to the control signals from the control unit 13, the solenoid operated valves 147 and 148 are actuated so that the air cylinders 88, 89, and 140 are extended or retracted. Thus the arm 92 and the separating plate 113 are swung about the pin 95 while the arm 130 of the lower manipulator member 65, about the pin 132. The air under pressure is delivered to the air cylinder 141 through a manually switching valve 149 (See FIG. 1) and an air line (not shown) from the air line 58 so that the arm 130 may be extended or retracted.

Figure 5:
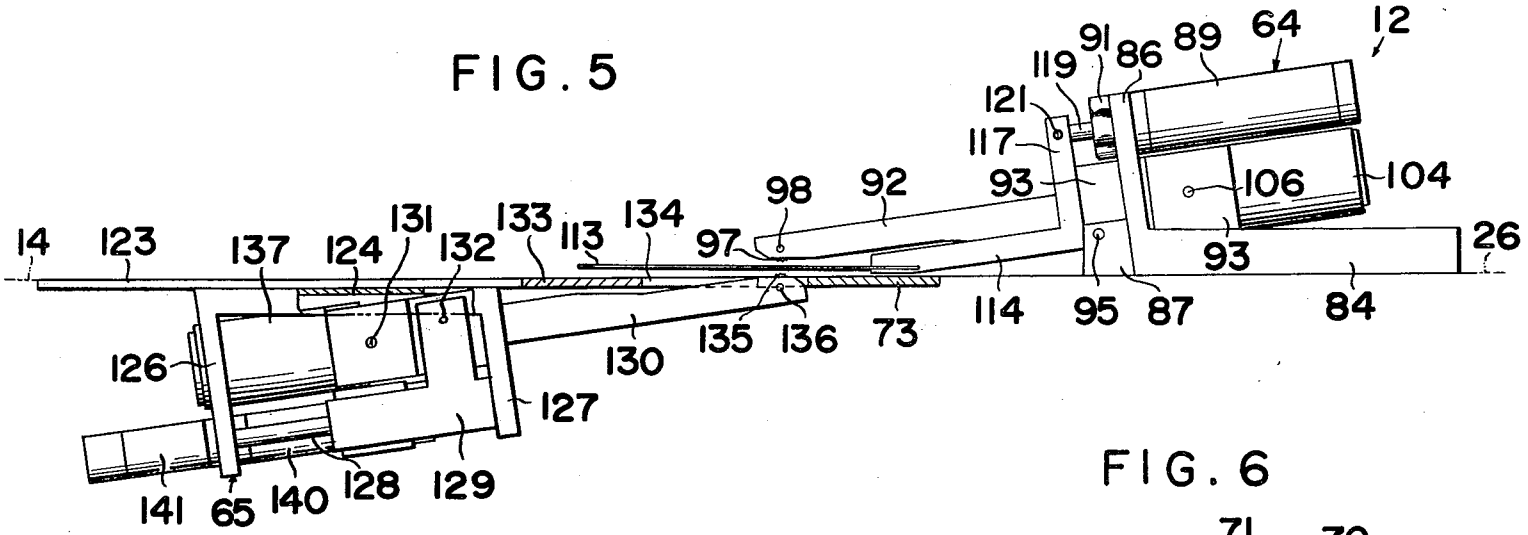
FIG. 5 is a front view thereof.

The piston rods of the air cylinders 88, 89, and 140 are normally held in the retracted position under the force of the springs (not shown) loaded in the air cylinders so that the pinions 97 and 135 carried by the upper and lower arms 92 and 130, respectively, are spaced apart from the separating plate 113 as best shown in FIG. 5. Under this condition, the upper sheet material is held between the upper pinion 97 and the separating plate 113 while the lower sheet material, between the lower pinion 135 and the separating plate 113. However, when the solenoid operated valves 47 and 48 are actuated in response to the control signals from the control unit 13, the piston rods of the air cylinders 88, 89, and 140 are extended so that the separating plate 113 is held in parallel with the upper surface of the worktable 14 while the upper and lower pinions 97 and 135 are pressed against the separating plate 113. As a result, the upper and lower sheet materials to be joined are clamped by the upper and lower pinions 97 and 135, respectively. In response to the output signals from the phototransistors 82, which detects the side edges of the upper and lower sheet materials to be joined in cooperation with the light emitting diode 81, the control unit 13 gives the control signal to the motors 104 and 137 so that the pinions 97 and 135 are driven to displace the sheet materials to the right or left until their side edges are precisely aligned with each other.

In the instant embodiment, the separating plate 113 is actuated by the air cylinder 89 while the lower arm 130 is actuated by the air cylinder 141 in order to facilitate the setting of the sheet materials to be joined to the sewing position and to prevent the feed mechanism and the like from hitting against the lower arm 130 when the arm-bed assembly 18 is inclined backwardly. However, it is to be understood that the instant embodiment is only one example of the present invention.

The control unit 13 may be so arranged that when the high-speed forward sewing is started as the required number of stitches are made by the low-speed reverse sewing in the manner described hereinbefore, the control unit 13 immediately gives the control signals to the solenoid operated valves 147 and 148, and actuates the sensor unit 63. Then, as shown in FIG. 3, the sensor unit 63 detects the side edges of the upper and lower sheet materials to be joined in the manner described hereinbefore. In response to the output signals from the sensor unit 63, the control unit 13 gives the control signals to the motors 104 and 137 of the upper and lower manipulator members 64 and 65 so that the motors 104 and 137 are driven in the forward or reverse direction. As a result, the pinions 97 and 135 cause the upper and lower sheet materials to be joined to displace toward the right or left until their side edges are precisely aligned with each other. Thus, the sheet materials may be sewn while their side edges are automatically aligned with each other. Moreover, it is readily seen that the margin to sew up may be suitably selected by the rotary switch 83 in the manner described hereinbefore.

During the sewing, the upper and lower sheet materials are pressed against the throat plate by the pressor foot 22 so that they may be fed to a predetermined direction. The feed mechanism is in direct engagement with the lower sheet material, but the upper sheet material is fed through the lower sheet material by the feed mechanism. As a result the feed of the upper material tends to be behind the feed of the lower sheet material especially in case of the slippery sheet materials. With the conventional sewing machine, the oprator aligns the edges of the sheet materials to be joined by his right hand while pulling the joined sheet materials away from the needle by the left hand so that there occurs no slip between the upper and lower sheet materials. Therefore, the full automatic sewing machines of the type similar to the automatic sewing machine in accordance with the present invention, means must be provided for preventing the slip between the upper and lower sheet materials while they are fed. According to the present invention, the air under pressure is supplied to the air cylinders 88 and 140 of the upper and lower manipulator members 64 and 66 through the pressure control valves 59 and 60, respectively, so that the upper and lower manipulator members 64 and 65 may be controlled independently of each other. Thus the pressures exerted to the upper and lower sheet materials through the pinions 97 and 135 from the upper and lower manipulator members 64 and 65 may be controlled independently of each other so that the upper and lower sheet materials may be fed together without any slippage therebetween. That is, the pressure of the air to be supplied to the air cylinders 88 and 140 may be suitably controlled by the pressure control valves 59 and 60 depending upon the physical properties such as tenacity, elongation, smoothness, thickness, and so on of the sheet materials to be joined. Thus according to the present invention, not only the upper and lower sheet materials may be positively fed without any slippage therebetween, but also either of the upper or lower sheet material or both of them may be fed while being elongated or stretched.

When the edge of the lower sheet material passes beyond the leftmost pair of the light emitting diode 81 and its corresponding phototransistor 82 which been so far covered with the sheet material, the sensor unit 63 gives the signal to the control unit 13 which in turn deactivates or de-energizes the sensor unit 63 and gives the control signals to the solenoid operated valves 147 and 148 so that the air cylinders 88, 89, and 140 are retracted. As a result, the upper and lower arms 92 and 130 are moved away from the separating plate 113 and returned to their initial positions. Thus the sheet materials are released from the upper and lower pinions 97 and 135. The control unit 13 also resets the solenoid valve 62 so that the clutch 31 is coupled to the auxiliary motor 30. As a result, the high-speed forward sewing is automatically switched to the low-speed forward sewing. When the counter in the control unit 13 counts a predetermined number of stitches formed by the low-speed forward sewing, the control unit 13 closes the solenoid circuit for the clutch in the feed mechanism so that the low-speed forward sewing is atomatically switched to the low-speed reverse switching. When a predetermined number of stitches formed by the low-speed reverse stitching is counted by the counter in the control unit 13, the control unit 13 opens the clutch solenoid circuit for the feed mechanism and the low-speed sewing switch in the control box 33 and closes the thread cutting circuit. The control box 33 cooperates with the slip ring 43 to control the rotation of the auxiliary motor 30 and the operation of the thread cutter or thread cutting mechanism in such a way that the thread may be cut off while the needle 21 is being lifted. Thereafter, when the needle 21 is returned to its uppermost position, the auxiliary motor 30 is stopped. In response to the signal from the control box 33 representing the completion of one sewing cycle, the control unit 13 gives the control signal to the solenoid operated valve 61 so as to retract the air cylinder 46, thereby lifting the pressor foot 22. Thus the sheet materials joined together may be taken away from the worktable 14, and the automatic sewing machine is reset or returned to the initial position. As described hereinbefore, according to the present invention, the atomatic sewing operation may be accomplished only by the depression of the start button 44 after the sheet materials to be joined have been set.

So far the present invention has been described as being applied to the industrial sewing machine of the type equipped with the automatic thread cutting mechanism and the automatic feed reversing mechanism, but it is to be understood that the present invention may be applied not only to the sewing machines not equipped with either of the automatic thread cutting or feed reversing mechanism but also to the sewing machines not equipped with both.

While the underlying principle of the present invention has been made clear in the illustrative embodiment thereof, there will be immediately clear and obvious to those skilled in the art many modifications in structure, arrangement, elements and components used in the practice of the invention, and otherwise which are particularly adapted for specific environments and operating requirements, without departing from the principle of the present invention. The appended claims are therefore intended to cover and embrace any such modifications, within the limits only of the true spirit and scope of the present invention.

What is claimed is:

1. An automatic sewing machine, comprising operating means for performing a plurality of operations, including sewing of a seam on upper and lower sheet materials which are to be joined and have side edges; selectively actuatable control means for controlling at least some of said operations in a programmed sequence; alignment control means rsponsive to operation of said selectively actuatable means for independently maintaining the side edges of each said upper and lower sheet materials in a position parallel to and at a predetermined spacing from said seam irrespective of deviations of the respective side edge from said position in direction toward or away from said seam, said alignment control means comprising an alignment control device including sensor means disposed forwardly of the needle hole in the throat plate of the arm-bed assembly of said automatic sewing machine for detecting the side edges of the upper and lower sheet materials to be joined and the finishing end of the sewing operation, and a pair of manipulator members disposed forwardly of said sensor means for — in response to a signal from said sensor means — causing the displacement of said sheet materials to be joind in such a way that said side edges are precisely aligned with each other, said pair of upper and lower manipulator members being provided on the upper surface and the undersurface, respectively, of the worktable of said automatic sewing machine so as to be symmetrical about said worktable, said upper manipulator member comprising a separating plate along the upper surface of which is advanced the upper sheet material and along the undersurface of which is advanced the lower sheet material and an arm extending slantingly downwardly toward the upper surface of said separating plate, said lower manipulator member comprising an arm extending slantingly upwardly toward the surface of said separating plate, said arms of said upper and lower manipulator members being operatively coupled to air cylinders, respectively, in such a way that said uper and lower sheet materials to be joined are clamped between said arms of the upper and lower manipulator members on the one hand, and the separating plate on the other hand, each of said arms including a pinion rotatably carried at the free end of the respective arm and an electric motor disposed at the base of the respective arm and drivingly coupled to said pinion through a driving shaft extending within the arm and a crown gear attached at the end remote from said electric motor in engagement with said pinion, whereby the rotation of said electric motor — which is controlled in response to a control signal — may be transmitted to said pinion.

2. An automatic sewing machine, comprising operating means for performing a plurality of operations, including sewing of a seam on upper and lower sheet materials which are to be joined and have side edges; selectively actuatable control means for controlling at least some of said operations in a programmed sequence; and alignment control means responsive to operation of said selectively actuatable control means for independently maintaining the side edge of each of said upper and lower sheet materials in a position parallel to and at a predetermined spacing from said seam irrespective of deviations of the respective side edge from said position in direction toward or away from said seam, including upper and lower manipulator members each having an arm extending toward the upper and lower side of said sheet materials, respectively, and a driven pinion rotatably carried at a free end of the respective arm for engaging the respective sheet material and, in response to deviations of the respective side edge, shifting the respective sheet material relative to said seam so as to maintain the respective side edge in said position parallel to and at a predetermined spacing from said seam.

3. An automatic sewing machine as set forth in claim 2 wherein said alignment control device comprises a. sensor means disposed forwardly of the needle hole in the throat plate of the arm-bed assembly of said automatic sewing machine for detecting the side edges of the upper and lower sheet materials to be joined and the finishing end of the sewing operation; and b. said pair of manipulator members being disposed forwardly of said sensor means for, in response to a signal from said sensor means, causing the displacement of said sheet materials to be joined in such a way that said side edges are precisely aligned with each other.

4. An automatic sewing machine as set forth in claim 3 wherein said sensor means comprises a. a pair of upper and lower holder members with a reflector means interposed therebetween, surfaces of said upper and lower holder members being in opposed relation with said reflector means spaced apart from said reflector means by a predetermined distance and provided with a V-shaped groove;

b. side edge sensor means comprising at least one pair of a light emitting diode and a phototransistor and disposed in the side walls, respectively, of each V-shaped groove; and c. sensing means for sensing the end of the seam comprising at least one further pair of a light emitting diode and a phototransistor disposed in the side walls, respectively, of the V-shaped groove of one of said upper and lower holder members and forwardly of said side edge sensor means toward the end of said one holder member.

5. An automatic sewing machine as set forth in claim 3 wherein a. said pair of upper and lower manipulator members are provided on the upper surface and the undersurface, respectively, of the worktable of said automatic sewing machine so as to be symmetrical about said worktable;

b. said upper manipulator member comprising i. a separating plate along the upper surface of which is advanced the upper sheet material and along the undersurface of which is advanced the lower sheet material; and ii. said arm extending slantingly downwardly toward the upper surface of said separating plate;

c. said arm of said lower manipulator member i. extending slantingly upwardly toward the undersurface of said separating plate; and d. said arms of said upper and lower manipulator members being operatively coupled to air cylinders, respectively, in such a way that said upper and lower sheet materials to be joined are clamped between said arms of the upper and lower manipulator members, on the one hand, and separating plate, on the other hand.

* * * * *